US009181004B2

(12) United States Patent
Ito

(10) Patent No.: US 9,181,004 B2
(45) Date of Patent: Nov. 10, 2015

(54) CAP WITH AN OPENABLE LID

(71) Applicant: Kabushiki Kaisha Hiro-Plus also trading as Hiro-Plus Co., Ltd., Chiba-ken (JP)

(72) Inventor: Hiroshi Ito, Chiba-ken (JP)

(73) Assignee: Kabushiki Kaisha Hiro-Plus, Chiba-Ken (JP)

( * ) Notice: Subject to any disclaimer, the term of this patent is extended or adjusted under 35 U.S.C. 154(b) by 86 days.

(21) Appl. No.: 14/016,555

(22) Filed: Sep. 3, 2013

(65) Prior Publication Data

US 2015/0060452 A1 Mar. 5, 2015

(51) Int. Cl.
*B65D 47/20* (2006.01)
*B65D 83/16* (2006.01)

(52) U.S. Cl.
CPC ..... *B65D 47/2018* (2013.01); *B65D 83/16* (2013.01)

(58) Field of Classification Search
CPC ..... B65D 47/08; B65D 2251/10; B65D 47/2018; B65D 43/26; B65D 41/0485; B65D 41/04
USPC ..... 215/273, 280, 305, 295, 216, 215, 235; 220/263, 810, 836, 845, 256.6, 257.2, 220/259.1, 256, 254.1, 254.3, 254.4, 284, 220/285; 222/562, 556, 544
See application file for complete search history.

(56) References Cited

U.S. PATENT DOCUMENTS

| | | | | |
|---|---|---|---|---|
| 3,770,168 | A * | 11/1973 | Sagarin | 222/182 |
| 5,746,338 | A * | 5/1998 | Takahashi et al. | 215/237 |
| 6,702,137 | B1 * | 3/2004 | Kowa et al. | 220/254.5 |
| 2003/0106901 | A1 * | 6/2003 | Meshberg | 222/1 |
| 2006/0000853 | A1 * | 1/2006 | Rueschhoff et al. | 222/402.13 |
| 2009/0283609 | A1 * | 11/2009 | Strand | 239/333 |

FOREIGN PATENT DOCUMENTS

| | | |
|---|---|---|
| JP | S4981178 | 8/1974 |
| JP | H033563 | 1/1991 |
| JP | H04106246 | 9/1992 |
| JP | 4007521 | 11/2007 |

* cited by examiner

*Primary Examiner* — Robert J Hicks
*Assistant Examiner* — Kareen Thomas
(74) *Attorney, Agent, or Firm* — DeLio, Peterson & Curcio LLC; Peter W. Peterson

(57) ABSTRACT

Containers are to be mounted with cap having structure usable without removing the cap. Cap with an openable lid of the present invention is that lid is rotated when reactive force against force added on pushing portion 3 reaches from hinge 4 to the lid 2 since radius of rotation of the hinge 4 provided at a predetermined position is smaller than radius of rotation of the pushing portion 3. Further, push button 5 is pushed in connection with opening of the lid since the pushing portion 3 is provided at the position where the pushing portion is adjacent to top edge of the push button 5 at the lid 2 being opened by the hinge 4. Thus, the force reaches the push button 5 through the pushing portion 3, and backward of the push button inclines. This makes it possible to realize a structure of discharging contents of container without removing cap.

18 Claims, 7 Drawing Sheets

CAP WITH AN OPENABLE LID

BACKGROUND OF THE INVENTION

1. Field of the Invention

Subject invention relates to a cap with an openable lid mounted on a container for discharging contents thereof by pushing a push button, and more particularly relates to a cap with an openable lid for discharging contents of a container by opening a lid constructing a part of the cap and the push button being pushed thereby.

2. Description of Related Art

Caps covering opening of container containing contents are well known, and cap by structure of mounting a lid to cap body through a hinge and exposing an opening by opening the lid is a type of such caps. This type of caps are not lost or forgotten to be on containers because the cap body is mounted to the container. However, it takes time and may be troublesome to disengage a lid from a hook of the cap body due to some required actions therefor, for example, flipping lid by fingers, pushing up lid by a hand while holding the container by the another hand, etc., and therefore, showing opening of the container may be troublesome.

A cap to be opened by pushing a pushing portion by fingers of a hand while holding the container by the same hand has been introduced (for example, JP Patent Application Publication No. 1998-338256). This cap consists of a cap body, a pushing portion freely connected to the cap body, and a lid portion connected to the pushing portion trough doubled hinge. A hook is mounted between the cap body and the lid portion, and a spigot is formed as projecting inside of the lid portion. Opening of container is covered and the lid portion is fixed on the cap body with the hook by setting the spigot in the opening of the container. The spigot is gotten off from opening of the container while the hook is released by holding the container, pushing the pushing portion, and rotating the lid portion connected to the pushing portion at the time of opening the cap.

PATENT DOCUMENTS

[Patent document] JP Patent Application Publication No. 1998-338256

SUMMARY OF THE INVENTION

Subject to be Solved by the Invention

It is not possible to discharge contents of the container by means of the above described cap unless the container is inclined. The pushing portion is to be pushed merely for opening the lid portion, so it is not applied at spray-type container for discharging contents by pushing a push button.

On spray-type containers, cap for protecting push button is mounted in the aspects of health and safety, but such cap is to be removed from container for use each time, and such cap is easily lost and/or forgotten to be mounted on the container. Thereby opening of container may be unclean by dirt or dust, and it causes difficulty of discharging contents of container. Therefore, cap having structure on which container is used without removing the cap has been wanted even for spray-type containers.

Push button for discharging contents of container is usually not detachably mounted on the container, so opening of container rotates and direction of the opening may be changed while in use. Therefore, it is necessary to substantially form the state that push button is fixed.

Further, in case that cap and push button are separated, the cap and push button have to be produced on respective procedures, and also each examination of quality and assembling are required. Therefore, structure of cap and push button together has been wanted in order to solve problems described above.

First object of the present invention is to provide a cap with an openable lid for discharging contents of container by pushing push button without removing the cap.

Second object of the present invention is to provide a cap with an openable lid for discharging contents of container at a desired direction when push button is pushed.

Third object of the present invention is to provide a cap with an openable lid, which cap and push button are integrally produced on a production process.

Means for Solving Problems

In order to solve the problems described above, cap with an openable lid of the present invention has feature that lid portion is provided on cap body and push button is pushed in connection with opening of the lid portion.

Cap with an openable lid of the present invention comprises a cap body for covering a push button including a discharge hole which is mounted on a container and a lid constructing at least a part of the outline of the cap body, and wherein the lid is connected to the cap body through a pushing portion and a hinge, a first foldable flexure connecting between the pushing portion and the cap body, a second foldable flexure connecting between the pushing portion and the lid, a third foldable flexure connecting between the hinge and the cap body, and a fourth foldable flexure connecting between the hinge and the lid are parallel to each other, the pushing portion is positioned on the opposite side to an opening formed by opening the lid, the hinge is placed at least one side of right and left sides adjacent to the pushing portion, the pushing portion is rotated around the first flexure, the hinge is rotated around the third flexure, the third flexure is positioned on the laterally-parallel track to the track of the second flexure moved in connection with the rotation of the pushing portion, the fourth flexure is positioned at the outside of the track of the second flexure and at the opening side of the lid, the radius of rotation of the hinge is smaller than the radius of rotation of the pushing portion, and the pushing portion is placed at the position adjacent to the top of the push button at the lid being opened.

It is preferable that outside of the push button is provided with side walls parallel to the direction of the discharge hole, the inside of the cap body is provided with inner walls parallel to the direction of the opening of the lid, and each side wall is respectively abutted to the corresponding inner wall when the cap is mounted on the container.

It is preferable that cross-section shape of the push button is non-circular shape, the cap body includes a button holder adapted to at least in a circumferential shape of the push button, the lower end of the button holder is provided with a plate member toward the same direction as the direction of the opening of the lid, and the plate member is connected with the end of the cap body.

It is preferable that the push button is rectangular, the button holder has a cap shape adjusted to the push button, and the side surface of the button holder is provided with an aperture at the position of opening the discharge hole of the push button.

It is preferable that the push button includes a button body with the discharge hole and a base member supporting the push button body, the lower end of the button body is provided with the plate member in the same direction as the direction of the discharge hole, and the plate member is connected to the upper end of the base member.

It is preferable that the push button is integrally formed with the cap body, the lower end of the push button is provided with the plate member in the same direction as the direction of the opening of the lid, and the plate member is connected to the end of the cap body.

It is preferable that the push button has an outwardly protruded nozzle, the discharge hole is placed at the distal end of the nozzle, the rear surface of the lid is provided with a drip off prevention, and the drip off prevention is placed at the position adjacent to the discharge hole at the lid being closed.

On explanation of the present invention, shapes of "cap body" and "push button" are not limited to cylindrical, but elliptical shape, polygonal column, and frustum may also be applied. "discharge hole" may be for discharging contents as being mist, liquid, or mousse, etc. Shapes of "lid" may be flat plate constructing a part of top-edge surface of cap body, L-shape constructing a part of each of top-edge surface and side surface of the cap body, or shape constructing whole of upper portion of the cap body.

"pushing portion" describes a portion where stress is added for opening a lid. "hinge" describes a portion for controlling rotation of the lid. "opposite side to an opening of the lid" describes that "opposite side" is backward when "opening of the lid" is front. "right and left sides adjacent to the pushing portion" corresponds not only to lateral directions but to oblique directions.

"first flexure", "second flexure", "third flexure", and "fourth flexure" correspond no only to members with slit or v-shaped groove but to hinge. The third flexure is "positioned on the rotational track of the second flexure" corresponds to the state that the second flexure and the third flexure are in the same straight line at the lid being closed, for example.

Hinge is "adjacent to the top of the push button at the lid being opened" corresponds to that neighborhood of the second flexure is, at least, adjacent to the top of the push button.

"side walls" corresponds not only to, for example, lateral wall of a push button having circular section partially cut as being a plane surface but to members having corrugated surface, or side wall portion of long side of cross-section shape of oval, etc.

Push button as "cross-section shape being non-circular" corresponds not only to rectangular or oval push buttons but to all push buttons not rotatable to button holder when the push button is mounted to the button holder.

"Button holder" corresponds to, for example, ring-shaped or cap-shaped member, and anti-slip members or/and sticky material may be affixed inside of the button holder.

Direction of "nozzle" may be cross directions, lengthwise directions, and oblique directions.

Effect of the Invention

On cap with an openable lid of the present invention, since radius of rotation of the hinge provided at a predetermined position is smaller than radius of rotation of the pushing portion, it is possible that the lid rotates when reactive force against force added on pushing portion reaches from hinge to the lid. Further, push button is pushed in connection with opening of the lid since the pushing portion is provided at the position where the pushing portion reaches top edge of the push button at the lid being opened. Thereby, it is possible to realize a structure of discharging contents of container by pushing push button without removing cap.

The push button may be fixed at a desired direction since side wall of outside of the push button is respectively abutted to corresponding inner wall of cap body when the cap is mounted on a container. Thereby, structure of always discharging contents of container at a desired direction can be practiced.

The push button is fixed at a desired direction without rotating thereof since cross-section shape of the push button is non-circular shape and button holder is adapted to at least in a circumferential shape of the bush button. Further, the button holder smoothly rotates up and down in connection with motion of the pushed push button since the button holder is connected with the end of cap body through a plate member provided toward the same direction as the direction of the opening of the lid. Thereby, it is possible to realize a structure of discharging contents of container at a desired direction at the push button being pushed.

It is possible to realize a structure of always discharging contents of container at a desired direction without coming away or declination of the button holder against motion of push button since the button holder is formed as cap shape adjusted to the rectangular push button, and side surface of the button holder is provided with an aperture at the position of opening the discharge hole of the push button.

Since the push button is integrally formed with the cap body, and the push button is connected to the end of the cap body through the plate member provided in the same direction as the opening of the lid, it is possible that the push button smoothly moves in connection with movement of the pushed pushing portion. This makes it possible to realize a structure of integrally producing the cap and the push button at a production process.

Since a drip off prevention provided on rear surface of the lid is placed at the position adjacent to the discharge hole of nozzle at the lid being closed, it is possible to prevent remaining liquid at front edge of the nozzle being blocked at the drip off prevention and dripping off of the liquid. This makes situation of that the drip off prevention blocks the discharge hole of the nozzle.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-7 of the drawings in which like numerals refer to like features of the invention.

Figure 1:
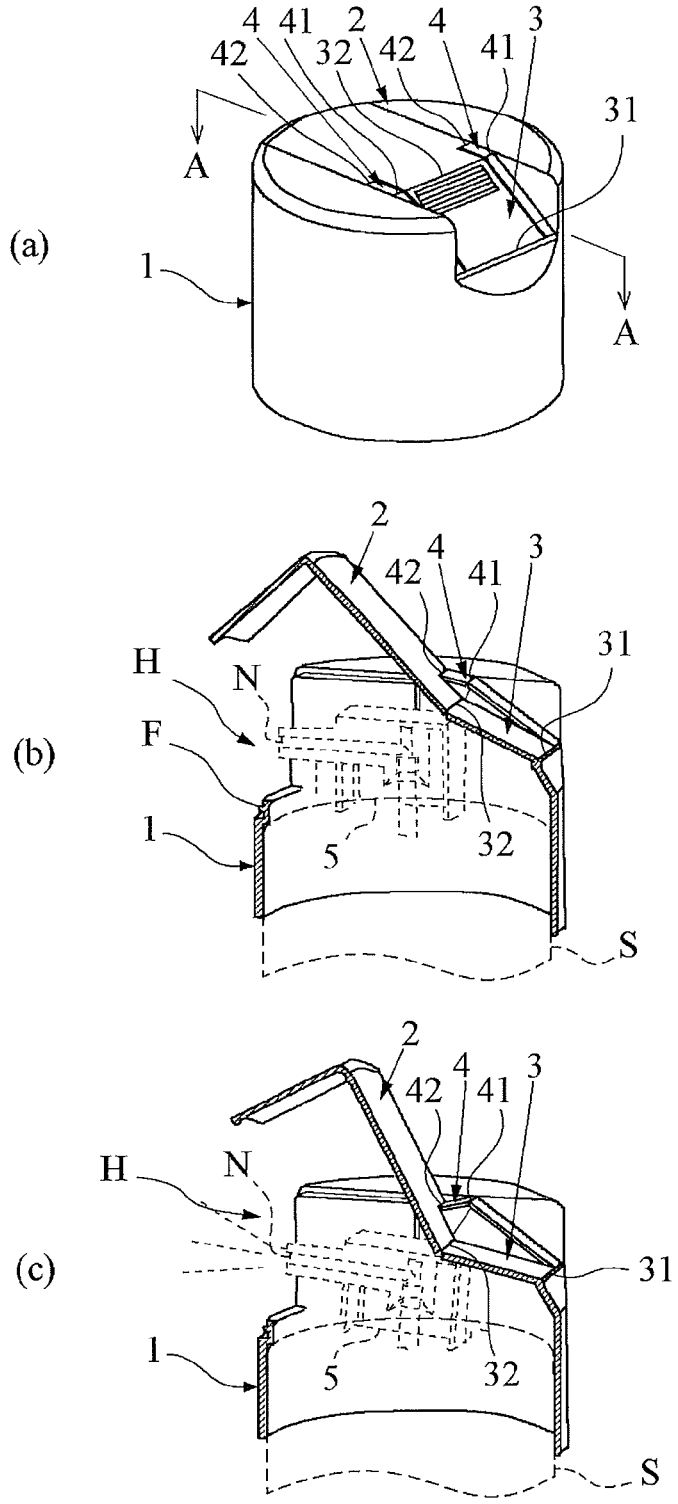
FIG. 1 is a perspective view and cross-section view of an embodiment of a cap with an openable lid in accordance with the present invention.

FIG. 1 shows basic structure of a cap with an openable lid in accordance with the present invention. FIG. 1 (*a*) is an outline view of a cap with an openable lid, FIGS. 1 (*b*) and (*c*) are cross-section views where the cap with an openable lid is used instead of usual caps. Assumed push button is described by dot-lines.

As shown in the FIGS. 1 (*a*) and (*b*), the cap with an openable lid comprises a cap body 1, which is cylindrical, hollow, and being mounted on a container S, for covering a push button 5 including a discharge hole N, and a L-shape lid 2 partially forming top surface and side surface of the cap body 1. The lid 2 is connected to the cap body 1 through a plate-shaped pushing portion 3 and a hinge 4. The portion where the pushing portion 3 and the cap body 1 are connected is a foldable first flexure 31. The portion where the pushing portion 3 and the lid 2 are connected is a foldable second flexure 32. The portion where the hinge 4 and the cap body 1 are connected is a foldable third flexure 41. The portion where the hinge 4 and the lid 2 are connected is a foldable fourth flexure. The first flexure 31, the second flexure 32, the third flexure 41, and the fourth flexure 42 are parallel each other, and these are provided at orthogonal oriented direction to an opening H, which is formed by opening of the lid 2. The pushing portion 3 is positioned on the opposite side to the opening H of the lid 2. The hinge 4 is respectively placed at the position of right and left sides adjacent to the pushing portion 3. The pushing portion 3 is rotated around the first flexure 31. The hinge 4 is rotated around the third flexure 41. The third flexure 41 is positioned on the laterally-parallel track to the track of the second flexure 32 moved in connection with the rotation of the pushing portion 3. The fourth flexure 42 is positioned at the outside of the track of the second flexure 32 and at the opening H side of the lid 2. The radius of rotation of the hinge 4 is smaller than the radius of rotation of the pushing portion 3. The pushing portion 3 is placed at the position adjacent to the top of the push button 5 at the lid 2 being opened.

Structure of the cap body 1, the lid 2, the pushing portion 3, and the hinge 4 is integrally injection-formed. The cap body 1 is notched for providing the lid 2, the pushing portion 3, and hinge 4. The notch is across top surface of the cap body 1 and reaches both of front side and rear side of side surface of the cap body 1. The lid 2 is placed as covering upper side of the opening H at the notch and being flush with top surface and side surface of the cap body 1. The pushing portion 3 is placed aslant as fingers being placed. The hinge 4 is placed as being flush with top surface of the cap body 1 and top surface of the lid 2.

The first flexure 31 is formed as connected to end edge of notch of the cap body 1 at the opposite side of opening H of the lid 2. The third flexure 41 is formed as connected to top of a portion projecting from inner wall of notch of the cap body 1 at the opposite side of opening H of the lid 2.

At end edge of notch of the cap body 1 at the same side of opening H of the lid 2, a hook F is provided for fixing the lid. On surface of the pushing portion 3, projecting portion is provided for preventing slip of fingers. The pushing portion 3 and the projecting portion are flush at the lid 2 being closed. At center of the push button 5, a hole is provided for inserting top of valve of the container S therein.

FIGS. 1 (*b*) and (*c*) show movement of the cap with an openable lid at a use situation. These figures are cross-section views at line A-A of FIG. 1 (*a*).

When the pushing portion 3 is pushed at the lid 2 being closed, stress by the pushing is broken down into force at the direction extending toward free end of the lid 2 and downward force right angle to the said extending direction. Since the lid 2 moves sideway by the divided force at the extending direction and hook F is unfastened, the pushing portion 3 is rotated downward around the first flexure 31 by the downward divided force. Then, the lid 2 is pulled downward since the lid 2 is connected to the pushing portion 3, and the lid 2 is rotated upward since the lid 2 is connected to the hinge 4 rotating at radius of rotate smaller than radius of rotate of the pushing portion 3. When stress against a force added at the pushing portion reaches from the hinge to the lid, the lid 2 is rotated around the fourth flexure 42. When the lid 2 is opened and a discharge hole N of the push button 5 begins to come out, the pushing portion 3 is at least adjacent to top of the push button 5. Further, when the pushing portion 3 is pushed, back side of the push button 5 inclines, and top of valve is pushed, and contents of the container is discharged.

On the cap with an openable lid, since radius of rotate of the hinge 4 provided at the predetermined position is smaller than radius of rotate of the pushing portion 3, stress against a force added at the pushing portion reaches from the hinge to the lid 2 and the lid is rotated. Further, since the pushing portion 3 is placed at the position adjacent to top of the push button 5 at the lid 2 being opened, the push button is pushed in connection with opening of the lid. This makes it possible to realize a structure of discharge contents of container by pushing the push button 5 without removing the cap.

Contents of container may be hair dressing, cosmetics, deodorant, insect killer, waterproof agent, bug repellent, cooling agent, refresher, antirust, perfume, or seasoning agent, but not limited thereto. Ways to mount the cap with an openable lid at container are putting lower end of the cap body 1 on top of the container S, and putting lower end of the cap body at chase or verge provided on top of the container.

FIGS. 2 to 6 show other embodiments of the cap with an openable lid.

In describing the preferred embodiments of the present invention, reference will be made herein to FIGS. 1 to 7 of the drawing in which like numerals refer to like features of the invention. Features of the invention are not necessarily shown to scale in the drawings.

Figure 2:
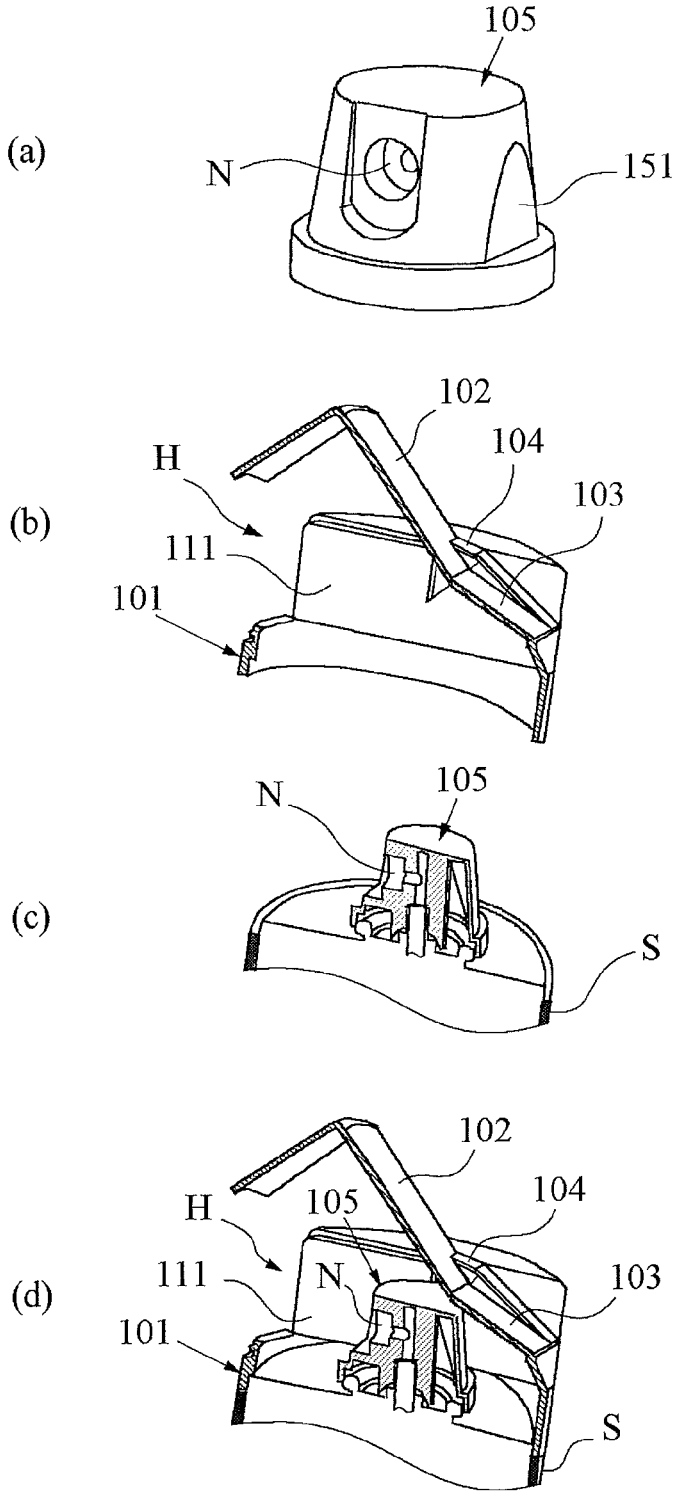
FIG. 2 is a perspective view of other push button, and various cross-section views of other cap with an openable lid.

FIG. 2 (*a*) is a perspective view of a push button for substitute, FIG. 2 (*b*) is a cross-section view of the cap with an openable lid, FIG. 2 (*c*) is a cross-section view of a container mounted with the push button, and FIG. 2 (*d*) is a cross-section view showing use situation of the cap with an openable lid.

FIG. 2 (*a*) is shown that flat side walls 151 are provided respectively parallel to direction of the discharge hole N on both sides of the push button 105. FIG. 2 (*b*) is shown that inner wall 111 is provided parallel to direction of the opening H of the lid 102 inside of a notch provided on the cap body 101. The inner wall 111 contacts with the side walls 151 when the cap body 101 is mounted on a container. FIG. 2 (*c*) is shown that the push button 105 does not contact with the container S, but the push button 105 is mounted as suspended.

FIG. 2 (*d*) describes behavior of the cap with an openable lid at use situation.

The side walls 151 of the push button 105 contact with inner wall 111 when the cap body 101 is mounted on the push button. Then, the discharge hole N of the push button 105 is fixed in the direction of the opening H of the lid 102.

Since the side walls of outside of the push button 105 contact with the inner wall of inside of the cap body when the cap with an openable lid is mounted on the container, the push button 105 can be fixed at a direction without rotating. This makes it possible to realize a structure of always discharging contents of the container at a desired direction when the push button 105 is pushed.

Figure 3:
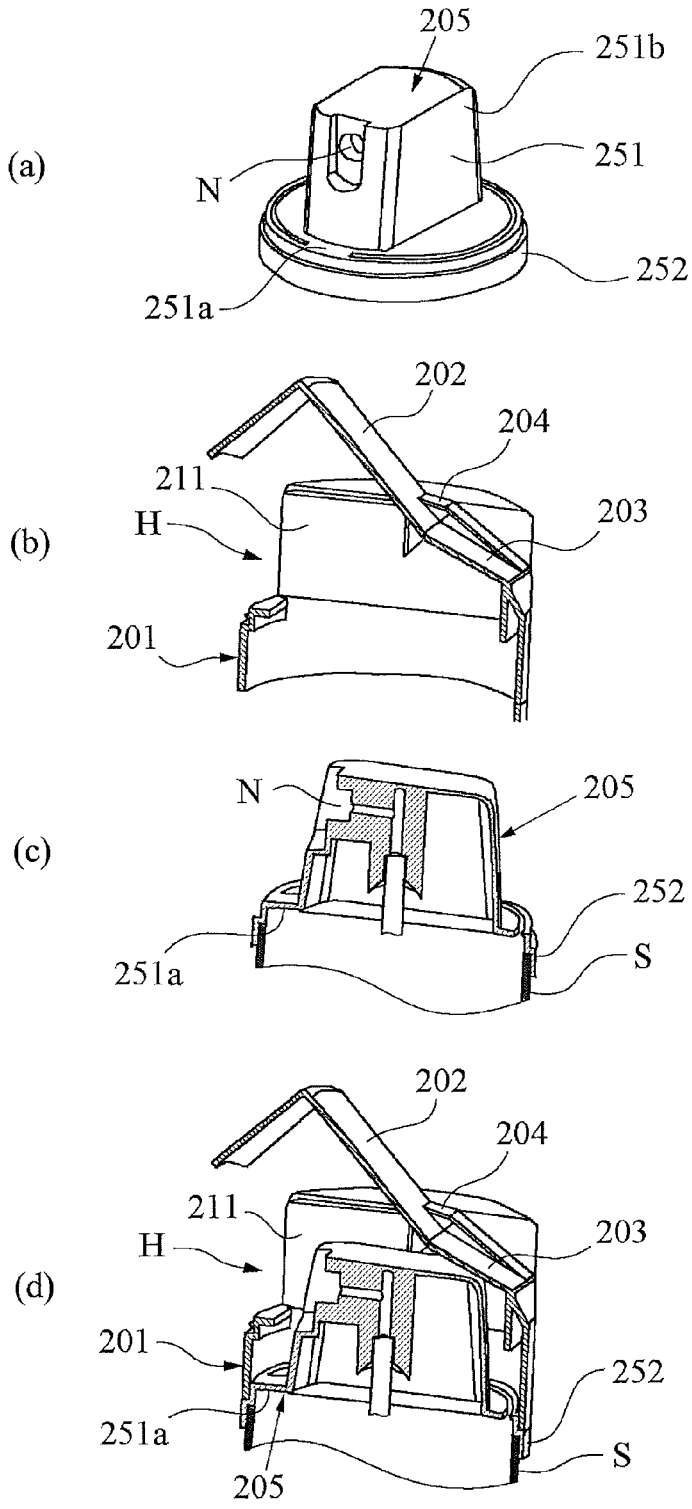
FIG. 3 is a perspective view of other push button, and various cross-section views of other cap with an openable lid.

FIG. 3 (*a*) is a perspective view of a spout-style push button attached to the cap with an openable lid, and FIG. 3 (*b*) is a cross-section view of the cap with an openable lid, and FIG. 3 (*c*) is a cross-section view showing use situation of the cap with an openable lid and the spout-style push button.

FIG. 3 (*a*) is shown that the spout-style push button 205 includes a button body 251 having a discharge hole N and a cylindrical base member 252 supporting the button body. The lower end of the button body 251 is provided with a plate member 251*a* in the same direction as the direction of the discharge hole N. The plate member 251*a* is connected to the upper end edge of the base member 252. It is preferable that width of the plate member 251*a* is as the button body 251 can be swung up and down around the position where the plate member 251*a* is connected to the base member 252. The cap body 201 is attached on the stepwise portion of the base member 252.

FIG. 3 (*d*) describes behavior of the said cap with an openable lid at use situation.

Flat portion 251*b* of the button body 251 contacts with inner wall 211 when the cap body 201 is mounted on the push button. Then, the discharge hole N of the push button 205 is fixed in the direction of the opening H of the lid 202.

Since the side walls of outside of the spout-style push button 251*b* contact with the inner wall 211 of inside of the cap body when the cap with an openable lid is mounted on the container, the spout-style push button 205 can be fixed at a direction without rotating. This makes it possible to realize a structure of always discharging contents of the container at a desired direction when the spout-style push button 205 is pushed. This also makes it possible to sell in sets with the spout-style push button 205 and the cap with an openable lid.

Figure 4:
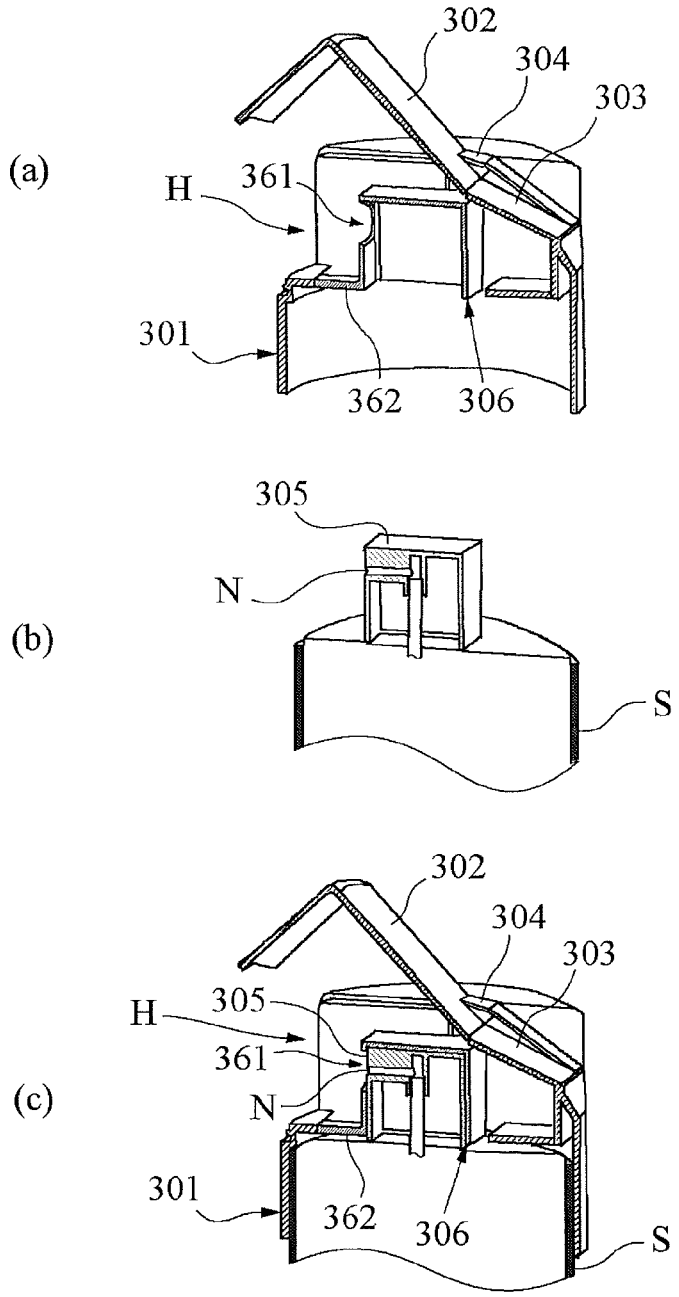
FIG. 4 is various cross-section views of other embodiment of a cap with an openable lid in accordance with the present invention.

FIG. 4 (*a*) is a cross-section view of other embodiment of a cap with an openable lid, and FIG. 4 (*b*) is a cross-section view of a container to be used with the cap with an openable lid, and FIG. 4 (*c*) is a cross-section view showing use situation of the cap with an openable lid.

As shown on FIGS. 4 (*a*) and (*b*), the cap with an openable lid is to be mounted on container S including a rectangular push button 305. Cap body 301 includes cap-style button holder 306 adjusted to the push button 305. The side surface of the button holder 306 is provided with a circular aperture 361 at the position of opening of the discharge hole N of the push button 305. The lower end of the button holder 306 is integrally provided with a plate member 362 toward the same direction as the direction of opening of the lid 302. The plate member 362 is connected to the edge of the cap body 301 near the discharge hole H. It is preferable that width of the plate member 362 is as the button holder 306 can be swung up and down around the portion where the plate member 362 is connected to edge of the cap body 301.

Shapes of the push button 305 and the button holder 306 are not limited to rectangular, but cross-section surface of them may be circular or oval. In such case, the button holder 306 may be circular or oval adjusted to circumferential shape of the push button 305.

FIG. 4 (*d*) describes behavior of the said cap with an openable lid described at use situation.

The push button 305 is put in the button holder 306 when the cap body 301 is mounted on the container S, then the discharge hole N comes to the position of the aperture 361. The pushing portion 303 is adjacent to top end of the push button 305 through the button holder 306 when the discharge hole N of the push button 305 begins to come out at the lid 302 being opened.

Figure 5:
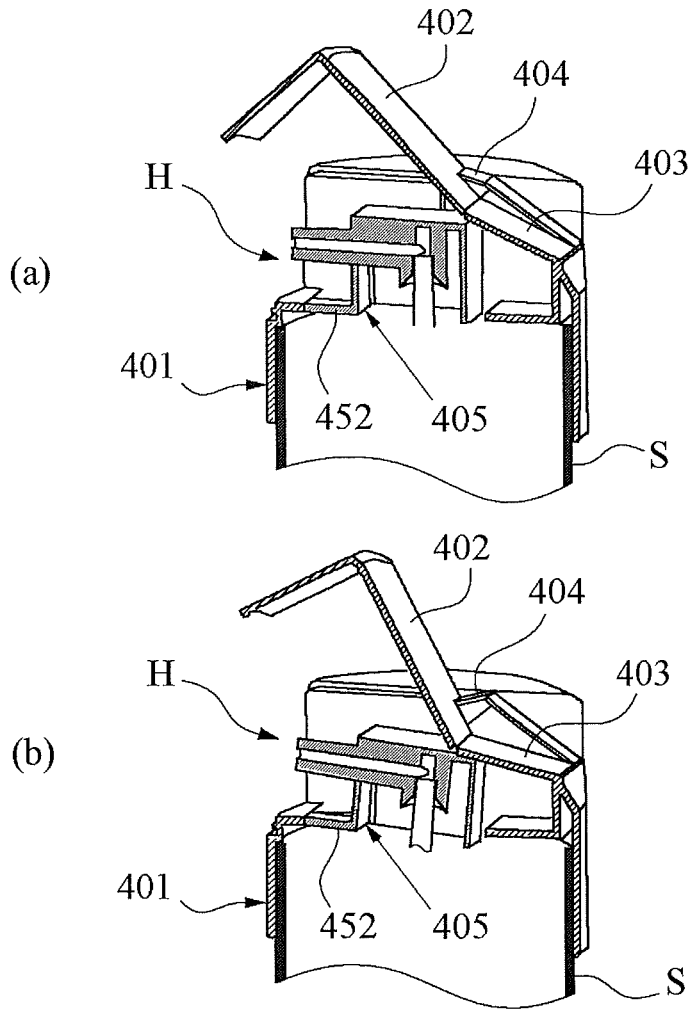
FIG. 5 is various cross-section views of other embodiment of a cap with an openable lid in accordance with the present invention.

Since the button holder 306 is cap shape adjusted to the rectangular push button 305, and aperture 362 is provided at the position of opening of the discharge hole N of the push button, it is possible to discharge contents of container at a desired direction without coming away or declination of the button holder against motion of the push button FIGS. 5 (*a*) and (*b*) are respectively shown cross-section view of use situation of cap with an openable lid integrally formed with push button.

As shown in FIGS. 5 (*a*) and (*b*), push button 405 is integrally formed with cap body 401. The lower end of the push button 405 is provided with plate member 452 in the same direction as the direction of opening H of lid 402. The plate member 452 is connected to the end of the cap body 401.

Since the push button 405 is integrally formed with the cap body 401, and the push button is connected to the end of the cap body through the plate member 452 provided in the same direction as the direction of opening H of the lid 402, the push button flexibly moves in connection with movement of pushed pushing portion 403. Accordingly, it is possible to realize a structure of integrally producing of the cap and the push button at a same production process.

Figure 6:
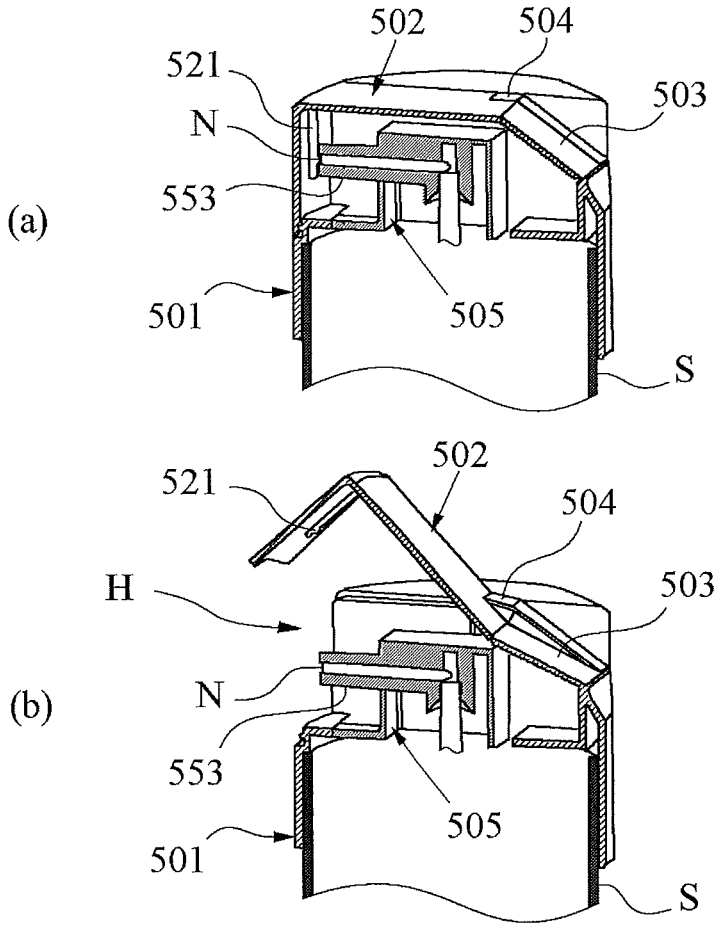
FIG. 6 is various cross-section views of other embodiment of a cap with an openable lid in accordance with the present invention.

FIGS. 6 (*a*) and (*b*) are respectively shown cross-section view of use situation of cap with an openable lid provided with a drip off prevention.

As shown in FIGS. 6 (*a*) and (*b*), push button 505 has an laterally protruded nozzle 553 and discharge hole N is placed at the distal end of the nozzle. Rear surface of foreside of L-shaped lid 502 is provided with a drip off prevention 521. The drip off prevention 521 is placed at the position blocking the discharge hole N at the lid 502 being closed. A projection adjusted to scale of the discharge hole N may be provided at the drip off prevention 521.

Since the drip off prevention 521 provided on rear surface of the lid 502 is placed at the position blocking the discharge hole N of the nozzle 553 at the lid being closed, it is possible to prevent remaining liquid at front edge of the nozzle being blocked at the drip off prevention and dripping off of the liquid after use.

Figure 7:
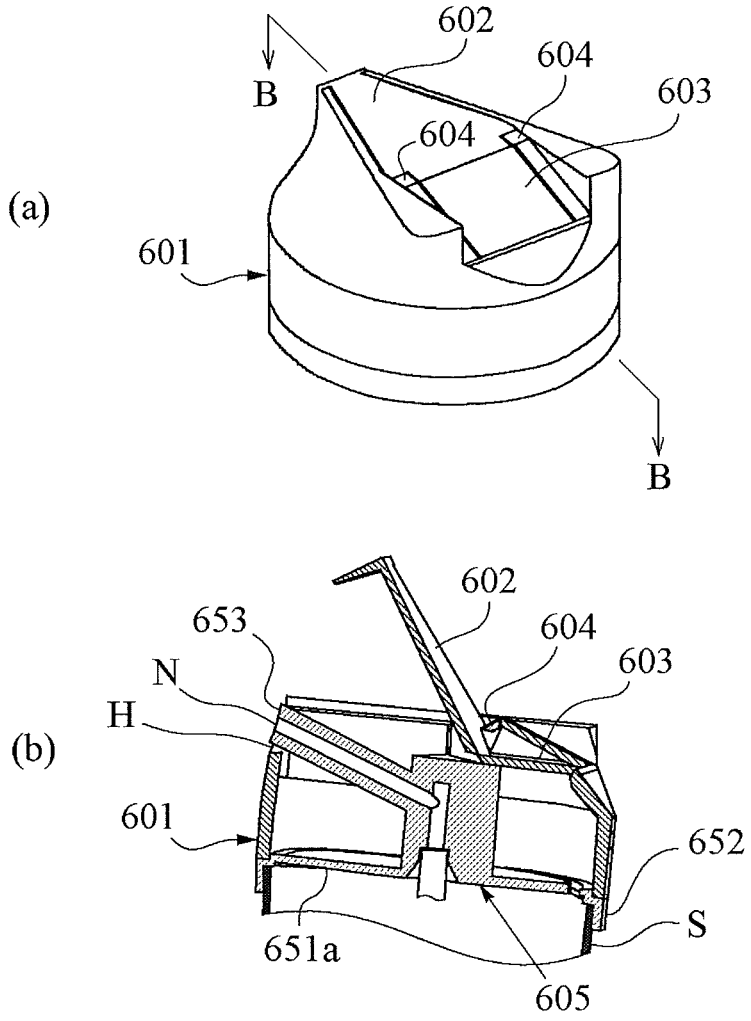
FIG. 7 is a perspective view and a cross-section view of other embodiment of a cap with an openable lid in accordance with the present invention.

FIG. 7 (*a*) is shown a perspective view of a cap with an openable lid suitable for containers for mousse, and FIG. 7 (*b*) is shown a cross-section view of use situation of the cap with an openable lid.

As shown in FIGS. 7 (*a*) and (*b*), cap body 601 is formed as side of opening H of lid 602 being narrower, and notch of the cap body 601 is triangular, and the lid 602 covers upper side of the notch. Push button 605 has a nozzle 653 projecting obliquely upward, and opening H is almost same size as front edge of the nozzle 653, and the front edge of the nozzle blocks the opening.

Accordingly, it is possible to prevent easily growing down of mousse-form contents but to easily discharge thereof since top edge of the nozzle 653 of the push button 605 blocks the opening H.

Various forms and structures of cap with an openable lid in the embodiments of the present invention are exemplified, but alternatives, modifications, and variations may be applicable within the scope and spirit of the present invention when push button provided on container, spout-style push button, or push button provided integrally with cap body are pushed in connection with movement of opening of lid openable by one push provided at cap body, or the said push button provided on container or spout-style push button are fixed at a direction without rotation (feature of positioning of button), for example. Further, the said various caps with openable lid may be formed by combination of respective forms and/or structures.

Containers to be mounted with the said various caps with openable lid apply to spray-type aerosol cans, pump-type dispensers, etc. Such aerosol cans include container, valve (stem) projecting at upper edge of the container, and push button (actuator) to be pushed when the valve is inserted and contents of the container is discharged, and other members and parts apply to conventional art, so explanations thereof are here omitted.

The cap with an openable lid of the present invention applies not only to business field of manufacturing and distribution of containers for discharging contents but to wide businesses of toys discharging contents thereof when the toy is switched on by pushing a push button, of electric lights emitting light when switched on.

| | |
|---|---|
| 1, 101-601 | cap body |
| 2, 102-602 | lid |
| 3, 103-603 | pushing portion |
| 31 | first flexure |
| 32 | second flexure |
| 4, 104-604 | hinge |
| 41 | third flexure |
| 42 | fourth flexure |
| 5, 105-605 | push button |
| F | hook |
| H | opening |
| N | discharge hole |
| S | container |

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A cap having an openable lid comprising a cap body for covering a push button including a discharge hole which is attached on a container with the lid constructing at least a part of an outline of the cap body, and wherein the lid is connected to the cap body through a pushing portion and a hinge, a first foldable flexure connecting between the pushing portion and the cap body, a second foldable flexure connecting between the pushing portion and the lid, a third foldable flexure connecting between the hinge and the cap body, and a fourth foldable flexure connecting between the hinge and the lid are parallel to each other, the pushing portion is positioned on an opposite side to an opening formed by opening the lid, the hinge is placed at least one side of right and left sides adjacent to the pushing portion, the pushing portion is rotated around the first flexure, the hinge is rotated around the third flexure, the third flexure is positioned on a track laterally-parallel to a track of the second flexure, which track of the second flexure is moved in connection with the rotation of the pushing portion, the fourth flexure is positioned at the outside of the track of the second flexure and at the opening side of the lid, the hinge having a radius of rotation smaller than a radius of rotation of the pushing portion, and the pushing portion is placed at the position adjacent to the top of the push button at the lid being opened.

2. The cap according to claim 1 wherein the outside of the push button is provided with side walls parallel to the direction of the discharge hole, the inside of the cap body is provided with inner side walls parallel to the direction of the opening of the lid, and each side wall is respectively abutted to the corresponding inner side wall when the cap is mounted on the container.

3. The cap according to claim 1 wherein the cross-section shape of the push button is non-circular shape, the cap body includes a button holder adapted to at least in a circumferential shape of the push button, the lower end of the button holder is provided with a plate member toward the same direction as the direction of the opening of the lid, and the plate member is connected with the end of the cap body.

4. The cap according to claim 3 wherein the push button is rectangular, the button holder has a cap shape adjusted to the push button, and the side surface of the button holder is provided with an aperture at the position of opening the discharge hole of the push button.

5. The cap according to claim 1 wherein the push button includes a button body with the discharge hole and a base member supporting the button body, the lower end of the button body is provided with the plate member in the same direction as the direction of the discharge hole, and the plate member is connected to the upper end of the base member.

6. The cap according to claim 2 wherein the push button includes a button body with the discharge hole and a base member supporting the button body, the lower end of the button body is provided with the plate member in the same direction as the direction of the discharge hole, and the plate member is connected to the upper end of the base member.

7. The cap according to claim 3 wherein the push button includes a button body with the discharge hole and a base member supporting the button body, the lower end of the button body is provided with the plate member in the same direction as the direction of the discharge hole, and the plate member is connected to the upper end of the base member.

8. The cap according to claim 4 wherein the push button includes a button body with the discharge hole and a base member supporting the button body, the lower end of the button body is provided with the plate member in the same direction as the direction of the discharge hole, and the plate member is connected to the upper end of the base member.

9. The cap according to claim 1 wherein the push button is integrally formed with the cap body, the lower end of the push button is provided with the plate member in the same direction as the direction of the opening of the lid, and the plate member is connected to the end of the cap body.

10. The cap according to claim 1 wherein the push button has an outwardly protruded nozzle, the discharge hole is placed at the distal end of the nozzle, the rear surface of the lid is provided with a drip off prevention, and the drip off prevention is placed at the position adjacent to the discharge hole at the lid being closed.

11. The cap according to claim 2 wherein the push button has an outwardly protruded nozzle, the discharge hole is placed at the distal end of the nozzle, the rear surface of the lid is provided with a drip off prevention, and the drip off prevention is placed at the position adjacent to the discharge hole at the lid being closed.

12. The cap according to claim 3 wherein the push button has an outwardly protruded nozzle, the discharge hole is placed at the distal end of the nozzle, the rear surface of the lid is provided with a drip off prevention, and the drip off prevention is placed at the position adjacent to the discharge hole at the lid being closed.

13. The cap according to claim 4 wherein the push button has an outwardly protruded nozzle, the discharge hole is placed at the distal end of the nozzle, the rear surface of the lid is provided with a drip off prevention, and the drip off prevention is placed at the position adjacent to the discharge hole at the lid being closed.

14. The cap according to claim 5 wherein the push button has an outwardly protruded nozzle, the discharge hole is placed at the distal end of the nozzle, the rear surface of the lid is provided with a drip off prevention, and the drip off prevention is placed at the position adjacent to the discharge hole at the lid being closed.

15. The cap according to claim 6 wherein the push button has an outwardly protruded nozzle, the discharge hole is placed at the distal end of the nozzle, the rear surface of the lid is provided with a drip off prevention, and the drip off prevention is placed at the position adjacent to the discharge hole at the lid being closed.

16. The cap according to claim 7 wherein the push button has an outwardly protruded nozzle, the discharge hole is placed at the distal end of the nozzle, the rear surface of the lid is provided with a drip off prevention, and the drip off prevention is placed at the position adjacent to the discharge hole at the lid being closed.

17. The cap according to claim 8 wherein the push button has an outwardly protruded nozzle, the discharge hole is placed at the distal end of the nozzle, the rear surface of the lid is provided with a drip off prevention, and the drip off prevention is placed at the position adjacent to the discharge hole at the lid being closed.

18. The cap according to claim 9 wherein the push button has an outwardly protruded nozzle, the discharge hole is placed at the distal end of the nozzle, the rear surface of the lid is provided with a drip off prevention, and the drip off prevention is placed at the position adjacent to the discharge hole at the lid being closed.

* * * * *